United States Patent [19]

Kaplan et al.

[11] 4,388,064

[45] Jun. 14, 1983

[54] ENERGY EFFICIENT HIGH STATIC PRESSURE FLUID FUEL BURNER

[75] Inventors: Robert A. Kaplan; James E. Wellman, both of Fort Wayne, Ind.

[73] Assignee: The Scott & Fetzer Company, Fort Wayne, Ind.

[21] Appl. No.: 176,973

[22] Filed: Aug. 11, 1980

[51] Int. Cl.[3] ..... F23Q 3/00

[52] U.S. Cl. ..... 431/265; 431/89; 431/351

[58] Field of Search ..... 431/265, 89, 351

[56] References Cited

U.S. PATENT DOCUMENTS

| | | | |
|---|---|---|---|
| 1,953,483 | 4/1934 | Higinbotham | 431/265 |
| 2,330,191 | 9/1943 | Beckett | 431/165 |
| 4,338,076 | 7/1982 | Straumann et al. | 431/265 |

FOREIGN PATENT DOCUMENTS

| | | |
|---|---|---|
| 477296 | 12/1937 | United Kingdom . |
| 479019 | 1/1938 | United Kingdom . |
| 658619 | 10/1951 | United Kingdom . |
| 1141380 | 1/1969 | United Kingdom . |

*Primary Examiner*—Carroll B. Dority, Jr.
*Attorney, Agent, or Firm*—Gust, Irish, Jeffers & Hoffman

[57] ABSTRACT

A gun-type fluid fuel burner having a blast tube with a fuel dispensing nozzle therein includes a blower housing having a scroll side wall and opposite end walls. The housing side wall has an upwardly facing air discharge opening therein which communicates with the blast tube, and one of the end walls has an air inlet opening therein. A squirrel cage blower wheel having a diameter more than twice its width is mounted for rotation in the housing and is directly driven by a two pole single phase alternating current motor mounted on one of the housing end walls, the blower drawing air through the input opening and discharging the air under pressure through the discharge opening. A damper plate is mounted on the housing for movement between an open position and a position closing the discharge opening, the damper being moved to its open position in response to air pressure from the blower and returning to its closed position under the influence of biasing force.

9 Claims, 8 Drawing Figures

ENERGY EFFICIENT HIGH STATIC PRESSURE FLUID FUEL BURNER

BACKGROUND OF THE INVENTION

1. Field of the Invention

This invention relates generally to gun-type fluid fuel burners, such as oil burners, and more particularly to an energy efficient, high static pressure burner.

2. Description of the Prior Art

Domestic gun-type oil burners conventionally comprise a blast tube having a fuel dispensing nozzle therein, a blower housing having an air discharge opening therein communicating with the blast tube, a motor-driven blower in the housing for providing combustion air to the blast tube, an ignition transformer mounted on the housing and connected to ignition electrodes positioned in the blast tube adjacent the fuel nozzle and, in the case of oil burners, a fuel pump driven by the blower motor.

In the past, the combustion chamber of conventional domestic furnaces has been exposed to a draft in the flue at all times. It has been known that combustion is improved and efficiency is increased by causing the burner to fire against a pressure in the combustion chamber rather than a draft; however, this requires the burner to provide a higher static pressure than has normally been required. Further, the normal draft in a conventional furnace during the "OFF" cycle of a conventional gun-type fluid fuel burner causes a loss of heat from the space being heated by air flow through the blower, blast tube and combustion chamber to the flue.

It is therefore desirable to provide an improved domestic, gun-type fluid fuel burner which provides higher than normal static pressure and further which eliminates stand-by heat losses due to draft through the burner.

SUMMARY OF THE INVENTION

In its broader aspects, the invention provides a gun-type fluid fuel burner having a blast tube with a fuel dispensing nozzle therein. A blower housing is provided having a scroll side wall and opposite end walls, the side wall having an air discharge opening therein communicating with the blast tube and one of the end walls having an air inlet opening therein. A blower wheel or rotor is mounted for rotation in the housing for drawing air through the inlet opening and discharging the same under pressure through the discharge opening. A damper plate is mounted on the housing for movement between an open position and a position closing one of the openings, the damper being moved to its open position in response to movement of air by the blower and returning to its closed position under the influence of biasing force.

In accordance with a further aspect of the invention, a squirrel cage blower wheel is provided having a diameter at least twice its width, the blower wheel being driven by a two-pole motor thereby providing higher tip velocity so as to move the same volume of air at a higher velocity thus providing higher static pressure in the blower housing.

It is accordingly an object of the invention to provide an improved gun-type fluid fuel burner.

Another object of the invention is to provide an improved gun-type fluid fuel burner which eliminates stand-by heat losses due to draft through the burner during the "OFF" cycle.

A further object of the invention is to provide an improved gun-type fluid fuel burner which provides higher static pressure in the blower housing thereby permitting the burner to be fired against a pressure in the combustion chamber of the furnace.

The above-mentioned and other features and objects of this invention and the manner of attaining them will become more apparent and the invention itself will be best understood by reference to the following description of an embodiment of the invention taken in conjunction with the accompanying drawings.

DESCRIPTION OF THE PREFERRED EMBODIMENT

Figure 1:
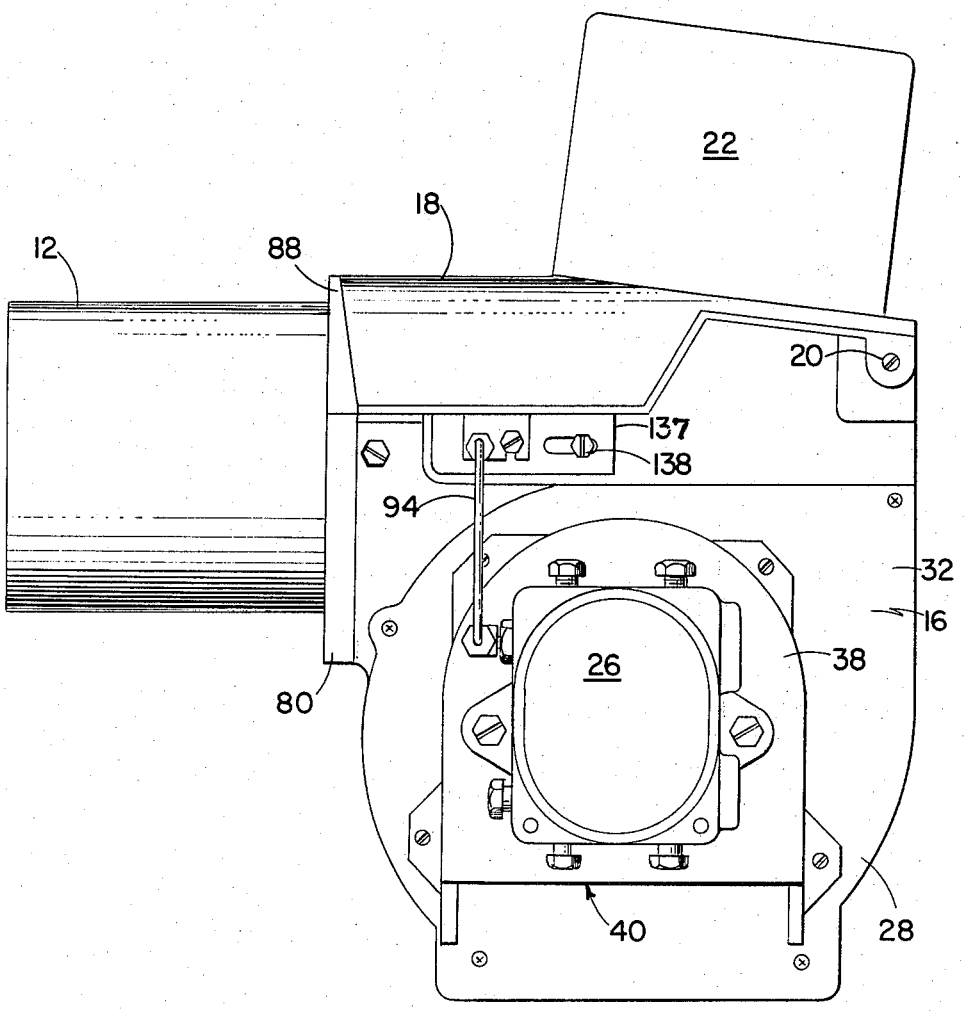
FIG. 1 is a side elevational view of one side of a gun-type oil burner incorporating the invention.

Referring to the figures of the drawings, a gun-type oil burner is shown, generally indicated at 10, comprising a blast tube 12 having a gun assembly 14 mounted therein, a blower housing 16, a cover member 18 pivotally connected to the blower housing, as at 20, an ignition transformer 22, a motor 24, and fuel pump 26.

Figure 2:
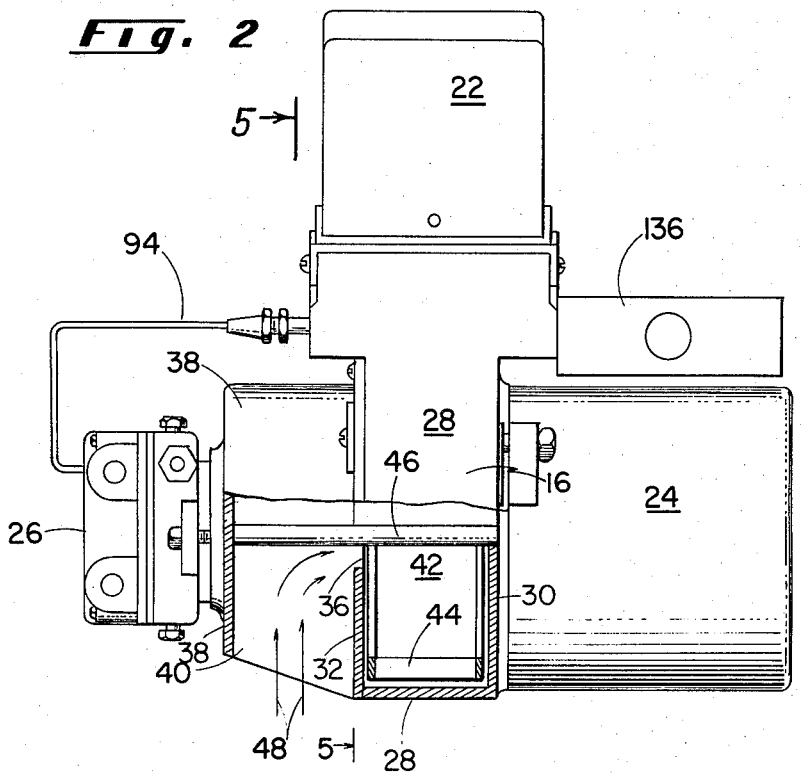
FIG. 2 is a rear view, partly broken away, of the oil burner of FIG. 1.

Blower housing 16 includes a scroll side wall 28 and opposite end walls 30, 32. Housing side wall 28 has upwardly facing air discharge opening 34 therein and end wall 32 has air inlet opening 36 therein (FIG. 2). Air intake housing 38 is secured to end wall 32 of blower housing 16 and has air inlet opening 40 therein communicating with air inlet opening 36 in end wall 32. Motor 24 is mounted on end wall 30 of blower housing 16 and fuel pump 26 is mounted on air intake housing 38.

Figure 5:
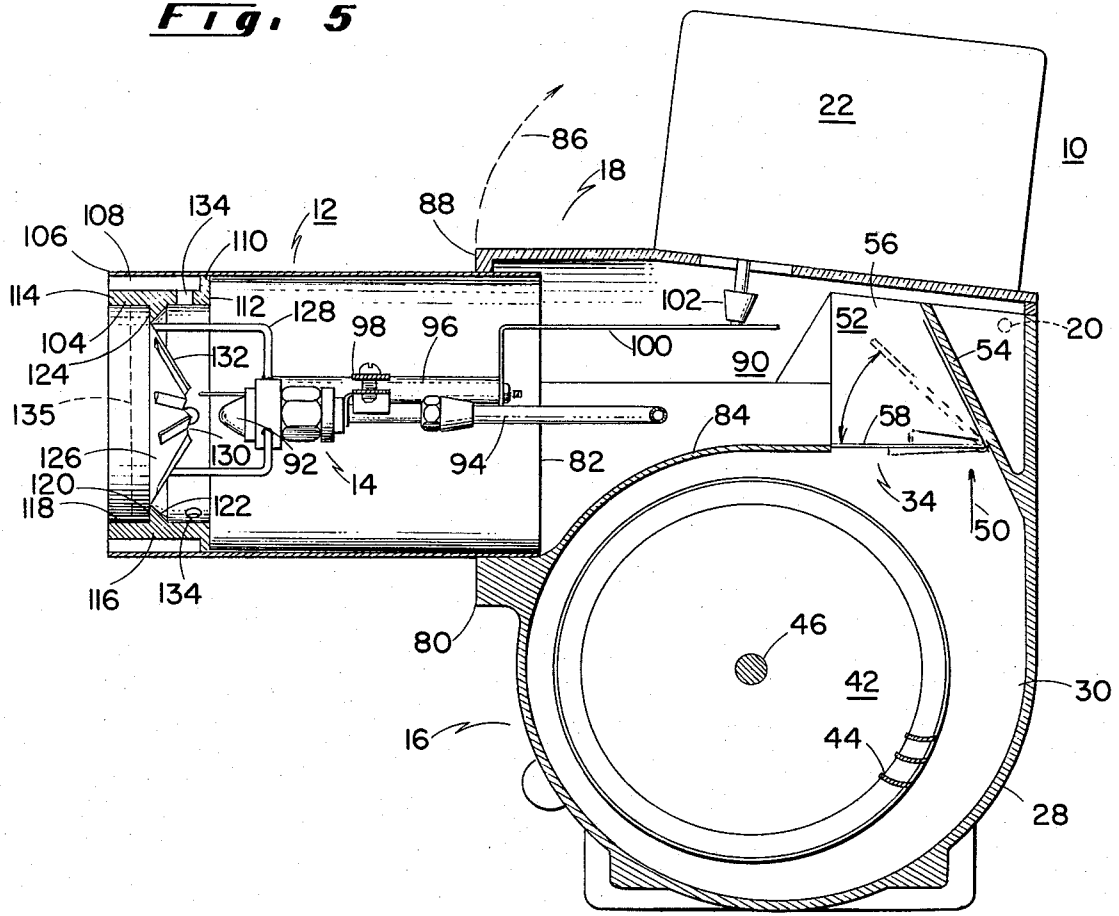
FIG. 5 is a cross-sectional view taken generally along the line 5—5 of FIG. 2.

Squirrel cage blower wheel 42 having impeller blades 44 around its periphery is mounted on motor shaft 46 in blower housing 16. Motor shaft 46 extends through air inlet opening 36 in end wall 32 and is coupled to drive fuel pump 26. Squirrel cage blower 42 thus draws air into blower housing 16 through air inlet opening 40 in air intake housing 38 and air inlet opening 36 in end wall 32, as shown by arrows 48, and discharges air under pressure through air discharge opening 34, as shown by arrow 50 (FIG. 5).

In accordance with the invention, in order to provide higher than normal static pressure, the diameter of squirrel cage blower wheel 42 is at least twice its width and motor 24 is a two-pole, single phase alternating current motor which thus drives squirrel cage blower wheel 42 at 3450 RPM; the blower motor employed in conventional domestic gun-type oil burners is a four-pole motor thus driving the blower at 1725 RPM. In a specific embodiment of the invention, squirrel cage blower wheel 42 has an outside diameter of 5½ inch and a width of 2⅛ inch, and motor 26 is a ⅛ horsepower motor, that oil burner developing a static pressure of 2.8 inches W/C whereas the static pressure developed by prior conventional gun-type oil burners in on the order of 1.60 inch W/C.

Air discharge passage 52 extends upwardly from upwardly facing air discharge opening or port 34 in scroll side wall 28 of blower housing 16, passage 52 being defined by rear wall 54 which extends upwardly from side wall 28, and upwardly extending walls 56 (FIG. 5) which respectively form extensions of end walls 30, 32 of blower housing 16. Damper plate 58 is provided in air discharge passage 52 pivotally connected to plate member 60 secured to rear wall 54 in any suitable manner, as by screws 62. Damper plate 58 is pivotally movable from a position closing air discharge opening 34, as shown in solid lines of FIG. 5, to an open position as shown in dashed lines. It will readily been seen that damper plate 58 is moved to its open position in response to air pressure in blower housing 16 caused by operation of squirrel cage blower wheel 42, and returns to its closed position under the influence of gravity when blower wheel 42 is not operating. In some instances, such as when the discharge port for the blower may not face upwardly, spring means (not shown) may be provided to urge the damper to its closed position.

Figure 3:
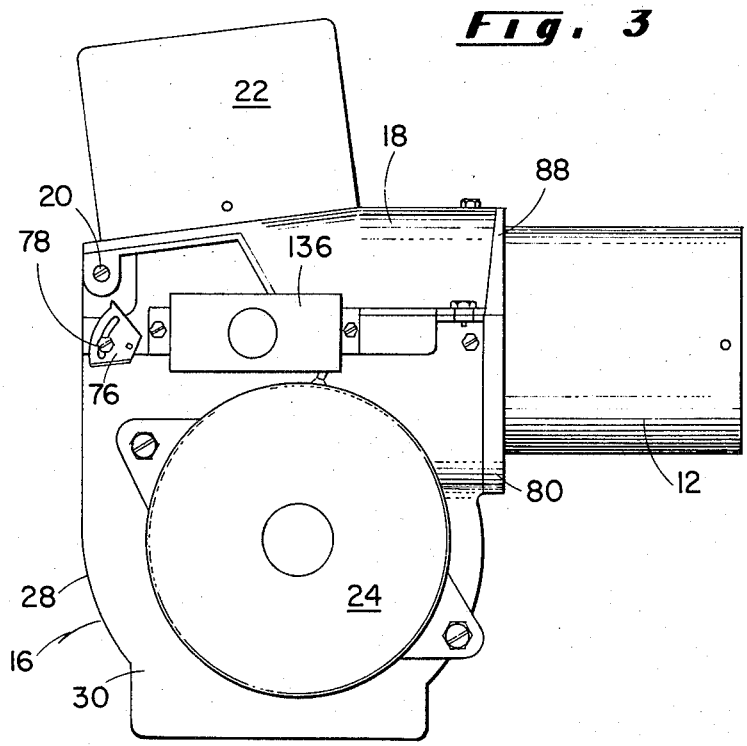
FIG. 3 is a side elevational view showing the other side of the oil burner of FIG. 1.
Figure 4:
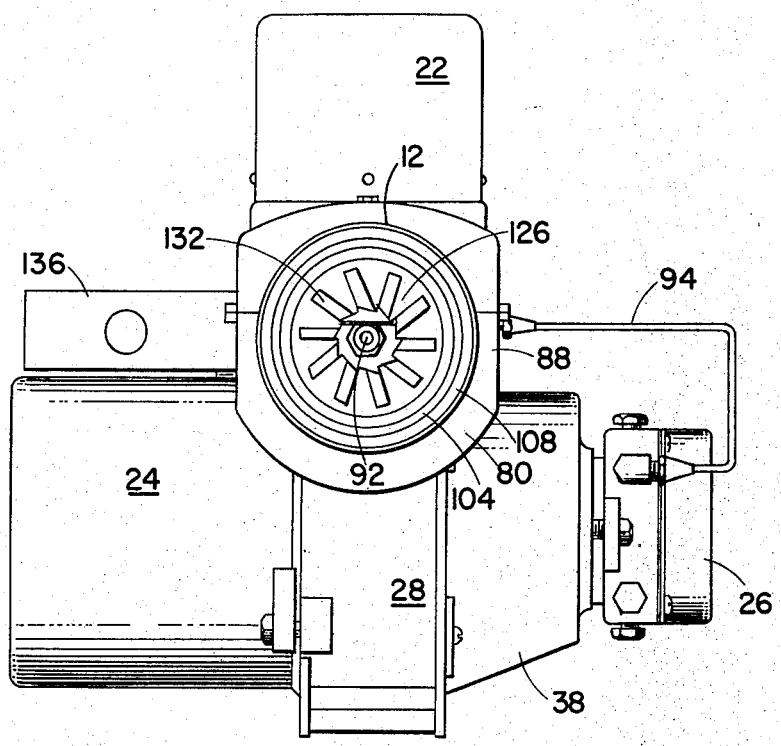
FIG. 4 is a front view of the oil burner of FIG. 1.
Figure 6:
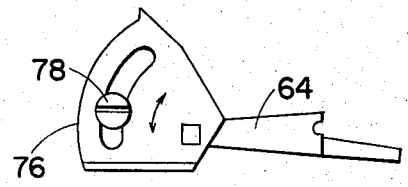
FIG. 6 is a fragmentary side view showing the damper adjustment mechanism.
Figure 7:
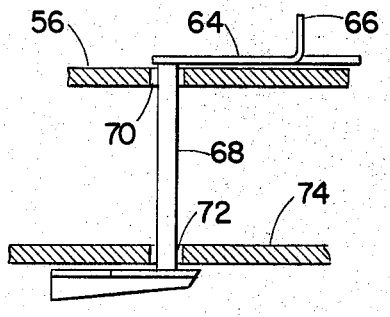
FIG. 7 is a fragmentary top view, partly in cross-section, further showing the damper adjustment mechanism.

The open position of damper plate 58 is selectively adjusted, in order selectively to adjust the static pressure, by means of lever 64 having leg portion 66 bent so as to overlay damper 58. Lever member 64 is pivotally mounted on one wall 56 by means of shaft 68 which extends through openings 70, 72 in wall 56 and outer wall 74 of blower housing 16, and which has manually adjusting quadrant 76 attached thereto (FIGS. 3, 6 and 7). Adjusting screw 78 secures adjusting quadrant 76 and lever member 64 at the desired location so as to determine the open position of damper plate 58.

Figure 8:
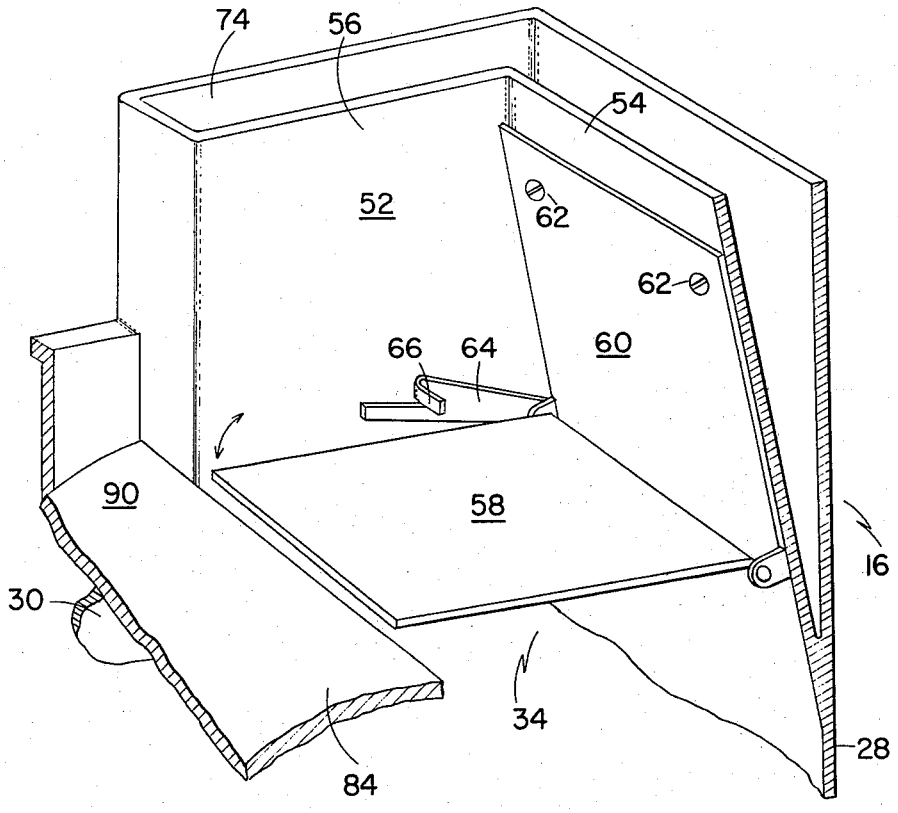
FIG. 8 is a fragmentary view in perspective further showing the damper and damper adjustment mechanism employed in the oil burner of the previous figures.

Blower housing 16 has yoke portion 80 formed thereon which receives and supports the lower part of inner end 82 of blast tube 12. Outer surface 84 (FIGS. 5, 8) of side wall 28 of blower housing 16 extends between air discharge opening 34 and yoke portion 80. Cover member 18 is pivotally movable between a closed position, as shown in FIG. 5, and an open position, as shown by arrow 86. Cover member 18 has yoke portion 88 which complements yoke portion 80 and in the closed position of cover member 18, in conjunction with yoke portion 80, embraces inner end 82 of blast tube 12. Cover member 18, in its closed position, defines with outer surface 84 of side wall 28 air passage 90 communicating between air discharge passage 52 and inner end 82 of blast tube 12.

Gun assembly 14 includes nozzle 92 connected to oil supply tube 94. Conventional ignition electrodes 96 are supported on either side of oil tube 94 by bracket 98 and have contacts 100 engaged by terminals 102 of transformer 22 when cover member 18 is in its closed position. Oil tube 94 is coupled to oil pump 26 in conventional fashion. Choke member 104 is positioned concentrically within blast tube 12 at its outer end 106 and defines annular space 108 therewith. Choke 104 has annular flange portion 110 at its inner end 112 which engages the interior surface of blast tube 12 so that annular space 108 is open at outer end 114 and closed at inner end 112. Annular projection 116 extends inwardly from inner surface 118 of choke member 104 between inner and outer ends 112, 114. Annular projection 116 has radially extending forward surface 120 and tapered rear surface 122 and defines central opening 124.

Conical flame retention member 126 is mounted on gun assembly 14 by means of brackets 128. Flame retention member 126 has its concave surface facing outer end 106 of blast tube 112, has central opening 130 coaxial with nozzle 92, and has louver openings 132 therein extending outwardly from central opening 130.

The outer diameter of flame retention member 126 is substantially the same as the inside diameter of central opening 124 defined by annular projection 116 on choke member 104. Gun assembly 14 and flame retention member 126 are selectively movable axially from the position shown in solid lines in FIG. 5 to the position shown in dashed lines at 135 by means of adjusting mechansim 137 shown in FIG. 1, adjusting screw 138 being provided to secure gun assembly 14 and flame retention member 126 in the desired position. Junction box 136 for making electrical connections to the burner is mounted on burner housing 16.

Flame retention member 126 and gun assembly 14 are positioned at their inner position, as shown in FIG. 5, for lower fuel rates of the burner in which less air is required for good combustion. In this position of flame retention member 126, all secondary air flows from blast tube 12 outwardly through openings 134 in choke member 104 communicating with annular space 108 between inner end 112 and annular projection 116. As flame retention member 126 and gun assembly 14 are moved outwardly toward the position shown in dashed lines at 135, more combustion air flows around flame retention member 126 thereby to provide proper combustion at higher fuel rates.

While the invention has been shown and described in conjunction with an oil burner, it will be readily understood that the invention is equally applicable to a gun-type gas burner.

It will now be seen that the invention provides an improved fuel efficient, high static pressure gun-type fluid fuel burner in which off-cycle heat losses are eliminated by an air pressure-open, gravity-closed damper and in which high static pressure is provided thus permitting use of the burner in a furnace in which the combustion chamber is maintained under pressure thereby improving heat transfer and further increasing fuel efficiency. Due to the simplicity of the design of the damper arrangement provided by the present invention, and particularly by reason of the fact that thw entire damper assembly is contained within the confines of the burner housing thereby inhibiting tampering by the user, the Underwriters Laboratories has ruled that an air-fuel interlock which has been required in prior burners in comparable installations is not required in the burner of the invention, thus permitting a substantial cost saving representing another advantage of the invention. The term "biasing force" as used herein to describe closing of the damper includes use of gravity and/or spring bias to assist closing.

While there have been described above the principles of this invention in connection with specific apparatus, it is to be clearly understood that this description is made only by way of example and not as a limitation to the scope of the invention.

What is claimed is:

1. In a gun-type fluid fuel burner having a blast tube with a fuel dispensing nozzle therein: a blower housing having a scroll side wall and opposite end walls, said side wall having an upwardly facing air discharge opening therein communicating with said blast tube and one of said end walls having an air inlet opening therein; a blower wheel mounted for rotation in said housing for drawing air through said inlet opening and discharging the same under pressure through said discharge opening; a damper plate mounted on said housing for movement between an open position and a position closing said discharge opening, said damper being moved to said open position thereof in response to movement of air by said blower and returning to said closed position under the influence of biasing force; and means for selectively adjusting said open position of said damper; said blast tube having inner and outer ends, said housing including a first yoke portion adapted to receive and support a part of said inner end of said blast tube, and further comprising a cover member pivotally connected to said housing end walls at a point spaced from said blast tube inner end for movement between open and closed positions, said housing side wall having an outer surface extending between said air discharge opening and said first yoke portion, said cover member having a second yoke portion complementing said first yoke portion and adpated in said closed position of said cover member in conjunction with said first yoke portion to embrace said inner end of said blast tube, said cover member in said closed position thereof defining with said outer surface of said side wall an air passage communicating between said air discharge opening and said inner end of said blast tube.

2. The burner of claim 1 wherein said housing includes an upwardly extending air discharge passage communicating between said discharge opening and said blast tube, said damper being positioned in said passage, said passage being defined by a rear wall which extends upwardly from said housing side wall and is inclined forwardly toward said blast tube, and by upwardly extending walls forming extensions of said end walls, said damper being pivotally connected to said rear wall.

3. The burner of claim 2 wherein said damper is pivotally connected to a plate member, said plate member being mounted on said rear wall.

4. The burner of claim 3 further comprising a lever member pivotally connected to one of said end wall extensions and having a portion overlaying said damper for limiting the movement thereof toward said open position, and means connected to said lever member for selectively adjusting the position thereof thereby selectively to adjust the open position of said damper.

5. The burner of claim 1 wherein said housing includes an upwardly extending air discharge passage communicating between said discharge opening and said first-named air passage, said last-named passage being defined by a rear wall which extends upwardly from said housing side wall and is inclined forwardly toward said inner end of said blast tube, and by upwardly extending walls on either side of said discharge opening, said damper being pivotally connected to a plate member, said plate member being mounted on said rear wall.

6. The burner of claim 1 wherein said blower wheel is of the squirrel cage type and has an outside diameter at least twice its width, and further comprising a two-pole, single phase alternating current motor mounted on one said housing side wall, said blower wheel being mounted on the shaft of said motor and being directly driven thereby.

7. A gun-type fluid fuel burner comprising: a blast tube with a fuel dispensing nozzle therein, said blast tube being cylindrical and having inner and outer ends; a cylindrical choke member having inner and outer ends disposed concentrically within said blast tube adjacent said outer end thereof and defining an annular space therewith, said choke member having an outwardly extending annular flange at its inner end engaging the inner surface of said blast tube whereby said annular space is open at said outer end of said choke member and closed at said inner end thereof, said choke member having an inwardly extending annular projection formed on its inner surface intermediate said ends and defining a central opening, said projection having a radially extending forward surface facing said outer end of said choke member and a rear surface which tapers outwardly and rearwardly from said forward surface to said inner choke member surface, said choke member having a plurality of openings therethrough intermediate said projection and said flange and communicating with said space, and a conical flame retention member within said choke member and having a concave surface facing said outer end thereof, said flame retention member being mounted on and supported by said nozzle, said flame retention member having a central opening coaxial with said nozzle and blast tube, said flame retention member having louver openings therein extending outwardly from said central opening, said flame retention member having an outside diameter substantially equal to the inside diameter of said choke member projection; means for selectively moving said nozzle and flame retention member axially between a first position with said flame retention member extending across said central opening in said choke member projection and a second position with said flame retention member intermediate said projection and said outer end of said choke member; a blower having a rotor and a housing which is connected to said inner end of said blast tube, said housing defining an air supply path leading through said rotor and thence through a blower discharge port in a peripheral wall portion of said housing to said inlet end of said blast tube; and damper means within the housing and movable between open and closed positions at which said air supply path is respectively open and closed, said damper means being normally biased to said closed position thereof but being moved to said open position in response to movement of air by the blower.

8. In a gun-type fluid fuel burner having a blast tube with a fuel dispensing nozzle therein: a blower housing having a scroll side wall and opposite end walls, said side wall having an upwardly facing air discharge opening therein communicating with said blast tube and one of said end walls having an air inlet opening therein; a blower wheel mounted for rotation in said housing for drawing air through said inlet opening and discharging the same under pressure through said discharge opening; a damper plate mounted on said housing for movement between an open position and a position closing said discharge opening, said damper being moved to said open position thereof in response to movement of air by said blower and returning to said closed position under the influence of biasing force; and means for selectively adjusting said open position of said damper, said blast tube being cylindrical with inner and outer ends, and further comprising a cylindrical choke member having inner and outer ends disposed concentrically within said blast tube at said outer end thereof and defining an annular space therewith, said choke member having an outwardly extending annular flange at its inner end engaging the inner surface of said blast tube whereby said annular space is open at said outer end of said choke member and closed at said inner end thereof, said choke member having an inwardly extending annular projection formed on its inner surface intermediate said ends and defining a central opening, said projection having a radially extending forward surface facing said outer end of said choke member and a rear surface which tapers outwardly and rearwardly from said forward surface to said inner choke member surface, said choke member having a plurality of openings therethrough intermediate said projection and said flange and communicating with said space, and a conical flame retention member within said choke member and having a concave surface facing said outer end thereof, said flame retention member being mounted on and supported by said nozzle, said flame retention member having a central opening coaxial with said nozzle and blast tube, said flame retention member having louver openings therein extending outwardly from said central opening, said flame retention member having an outside diameter substantially equal to the inside diameter of said choke member projection, and means for selectively moving said nozzle and flame retention member axially between a first position with said flame retention member extending across said central opening in said choke member projection and a second position with said flame retention member intermediate said projection and said outer end of said choke member.

9. In a gun-type fluid fuel burner having a blast tube with a fuel dispensing nozzle therein: a blower housing having a scroll side wall and opposite end walls, said side wall having an upwardly facing air discharge opening therein communicating with said blast tube and one of said end walls having an air inlet opening therein; a blower wheel mounted for rotation in said housing for drawing air through said inlet opening and discharging the same under pressure through said discharge opening; a damper plate mounted on said housing for movement between an open position and a position closing said discharge opening, said damper being moved to said open position thereof in response to movement of air by said blower and returning to said closed position under the influence of biasing force; said blast tube having inner and outer ends, said housing being adapted to support said inner end of said blast tube, and further comprising a cover member pivotally connected to said housing end walls at a point spaced from said blast tube inner end for movement between open and closed positions, said housing side wall having an outer surface extending between said air discharge opening and said inner end of said blast tube; said cover member in said closed position thereof defining with said outer surface of said side wall an air discharge passage communicating between said air discharge opening and said inner end of said blast tube, said open position of said damper lying within said discharge passage.

* * * * *